US009205295B2

(12) United States Patent
Williams

(10) Patent No.: US 9,205,295 B2
(45) Date of Patent: Dec. 8, 2015

(54) EXERCISE DEVICE

(71) Applicant: Ronald Williams, Draper, UT (US)

(72) Inventor: Ronald Williams, Draper, UT (US)

( * ) Notice: Subject to any disclaimer, the term of this patent is extended or adjusted under 35 U.S.C. 154(b) by 0 days.

(21) Appl. No.: 13/915,567

(22) Filed: Jun. 11, 2013

(65) Prior Publication Data

US 2013/0337982 A1 Dec. 19, 2013

Related U.S. Application Data

(60) Provisional application No. 61/659,230, filed on Jun. 13, 2012, provisional application No. 61/789,507, filed on Mar. 15, 2013.

(51) Int. Cl.
*A63B 21/00* (2006.01)
*A63B 21/02* (2006.01)
(Continued)

(52) U.S. Cl.
CPC ..... *A63B 21/0012* (2013.01); *A63B 21/00065* (2013.01); *A63B 21/02* (2013.01); *A63B 21/0428* (2013.01); *A63B 21/0552* (2013.01); *A63B 21/1469* (2013.01); *A63B 21/1488* (2013.01); *A63B 23/0211* (2013.01); *A63B 23/03525* (2013.01); *A63B 23/03541* (2013.01);
(Continued)

(58) Field of Classification Search
CPC ..... A63B 21/0004; A63B 21/00043; A63B 21/00061; A63B 21/02; A63B 21/023; A63B 21/025; A63B 21/026; A63B 21/04; A63B 21/0407; A63B 21/0421; A63B 21/0428; A63B 21/0442; A63B 21/05; A63B 21/055; A63B 21/0553; A63B 21/0557; A63B 22/0002; A63B 22/20; A63B 22/201; A63B 22/203; A63B 23/0417; A63B 23/0423; A63B 23/0429; A63B 23/04; A63B 23/048; A63B 23/12; A63B 23/1209; A63B 23/1236; A63B 23/1263; A63B 23/1272; A63B 2021/02; A63B 2021/021; A63B 2021/022
USPC ..... 482/70–71, 79, 95–96, 121–126, 482/128–130, 133–138
See application file for complete search history.

(56) References Cited

U.S. PATENT DOCUMENTS 1,984,165 A 12/1934 Tolchin
4,111,417 A * 9/1978 Gardner ..... 482/128
(Continued)

FOREIGN PATENT DOCUMENTS

GB 2 473 902 A 3/2011

OTHER PUBLICATIONS

X-Press Machine, http://www.expertfitnessuk.co.uk/x-press-machine-277-c.asp; pp. 1-2, printed Feb. 18, 2014.
(Continued)

*Primary Examiner* — Oren Ginsberg
*Assistant Examiner* — Jennifer M Deichl
(74) *Attorney, Agent, or Firm* — David R. Conklin; Kirton McConkie

(57) ABSTRACT

The present invention provides an exercise machine for developing the chest muscles while maintaining correct biomechanical posture and joint movement for the user, thereby maximizing efficiency and safety. The present invention includes a track in which two handles independently slide. The handles are interconnected to either an end bridge or a middle bridge by one or more tensioning elements that are configured to provide gradual and progressively increased resistance as a distance between the interconnected components increases.

19 Claims, 15 Drawing Sheets

(51) Int. Cl.

| | |
|---|---|
| ***A63B 21/055*** | (2006.01) |
| ***A63B 23/02*** | (2006.01) |
| ***A63B 23/035*** | (2006.01) |
| ***A63B 23/04*** | (2006.01) |
| ***A63B 23/12*** | (2006.01) |
| ***A63B 21/04*** | (2006.01) |
| ***A63B 22/20*** | (2006.01) |
| ***A63B 71/02*** | (2006.01) |

(52) U.S. Cl.

CPC ..... *A63B 23/0488* (2013.01); *A63B 23/1236* (2013.01); *A63B 21/00061* (2013.01); *A63B 21/1465* (2013.01); *A63B 22/203* (2013.01); *A63B 23/03508* (2013.01); *A63B 23/1281* (2013.01); *A63B 2022/206* (2013.01); *A63B 2071/027* (2013.01); *A63B 2208/0204* (2013.01); *A63B 2208/0219* (2013.01)

(56) References Cited

U.S. PATENT DOCUMENTS

| | | | | |
|---|---|---|---|---|
| 4,171,805 | A | 10/1979 | Abbott | |
| 5,226,868 | A | 7/1993 | Montgomery | |
| 5,295,935 | A * | 3/1994 | Wang | 482/130 |
| 5,643,162 | A * | 7/1997 | Landers et al. | 482/131 |
| 6,071,217 | A | 6/2000 | Barnett | |
| 6,186,930 | B1 | 2/2001 | Ignaczak | |
| 7,108,643 | B2 | 9/2006 | Wilson et al. | |
| 7,125,367 | B1 | 10/2006 | Stearns | |
| 7,438,673 | B1 * | 10/2008 | Jones | 482/71 |
| 7,645,218 | B2 | 1/2010 | Potok | |
| D627,011 | S | 11/2010 | Potok | |
| 7,892,152 | B1 | 2/2011 | Teng | |
| 7,998,043 | B2 | 8/2011 | Zhou et al. | |
| 8,118,718 | B2 | 2/2012 | Brodess et al. | |
| 8,137,251 | B2 | 3/2012 | Tozzi | |
| 2004/0053752 | A1 * | 3/2004 | Yang | 482/70 |
| 2010/0317496 | A1 | 12/2010 | Abranchess | |
| 2011/0077136 | A1 * | 3/2011 | Tozzi | 482/141 |
| 2012/0028770 | A1 | 2/2012 | Barchi | |
| 2012/0258843 | A1 | 10/2012 | Summers | |
| 2012/0277075 | A1 | 11/2012 | Ho | |
| 2013/0072364 | A1 | 3/2013 | Chen | |
| 2013/0123081 | A1 | 5/2013 | Boland | |

OTHER PUBLICATIONS

Rip Deck, https://www.perfectripdeck.com/, pp. 1-2, printed Feb. 18, 2014.

Push Up Machine with Leg Fitness, http://www.alibaba.com/product-gs/480597462/Push_Up_Machine_with_leg fitness.html, pp. 1-4, printed Feb. 3, 2014.

Torso Track, http://www.torsotrack.com; pp. 1-2, printed Oct. 8, 2013.

Bowflex UpperCut, http://www.bowflexuppercut.com/bowflex-uppercut/homepage.jsp, pp. 1-3, printed Oct. 8, 2013.

* cited by examiner

EXERCISE DEVICE

RELATED APPLICATIONS

This application claims priority to U.S. Provisional Patent Application Ser. No. 61/659,230, filed Jun. 13, 2012 and entitled MULTIPLE CHEST/PUSHUP MACHINE PROVIDING FULL CONTRACTION ARC WITH PROGRESSIVE ONE-WAY RESISTANCE, and U.S. Provisional Patent Application Ser. No. 60/789,507, filed Mar. 15, 2013, and entitled MULTIPLE CHEST/PUSHUP MACHINE PROVIDING FULL CONTRACTION ARC WITH PROGRESSIVE ONE-WAY RESISTANCE, each of which is incorporated herein in their entireties.

TECHNICAL FIELD

The present invention relates to exercise machines. More particularly, the present invention relates to an exercise machine that combines the motions of a pushup with a dumbbell fly with the user in a prone or pushup position. The exercise machine comprises various features to ensure proper biomechanical motion of the user thereby preventing injury and maximizing efficiency in muscular development.

BACKGROUND

All skeletal muscles throughout the human body comprise an anatomical arc structure. See Faith and Fat Loss by Ron Williams, RTW Publishing International; First edition, 2009, incorporated herein in its entirety. This arc structure permits the muscle to contract and relax to achieve desired skeletal movements. The majority of muscles in the body are attached or anchored by ligaments and tendons to one or more stable skeletal bones and one or more mobile bones. The mobile bones are moved relative to the stable skeletal bones as the muscle is contracted and extended.

The chest muscles (i.e. pectoralis major and minor) are connected to the sternum, the clavicle, and the upper humerus, thereby forming an arc structure for these muscles. The chest muscles are contracted and extended to move the mobile, upper humerus bone with respect to the stable positions of the sternum and clavicle bones. The ball and socket anatomy of the shoulder joint comprises an extensive range of motion which permits medial and lateral rotation of the humerus. The chest muscles are contracted as the humerus adducts and rotates medially or internally towards the sternum. Conversely, the chest muscles are extended or relaxed as the humerus abducts and rotates laterally or outwardly away from the sternum. Based on this anatomy, maximum chest development is achieved when the chest muscles are optimally contracted and extended as part of a weight training activity. Maximum chest development is further achieved when weight training activities account for, and utilize the anatomical arc structure of the chest muscles.

Weight training or weight lifting is a common type of strength training for developing the strength and size of skeletal muscles. Weight training uses the weight force of gravity to oppose the force generated by muscle through concentric or eccentric contraction. Weight training uses a variety of specialized equipment to target specific muscle groups and types of movement.

Weight training may be performed using various types of equipment. In some instances, weight training is performed using free-weights. A free-weight can be classified as any object or device that can be moved freely in three-dimensional space. Examples of common free-weights include dumbbells, barbells, high/low or adjustable pulley systems, lat pull-down and low row devices, medicine balls, kettle bells, ankle weights, and the human body. In reality, any object that is free to move in three-dimensional space that is not fixed to any specific set of axis can be considered a free-weight.

Weight training may also be performed using an exercise machine. Unlike free-weights, an exercise machine is designed to limit the biomechanical motion of a portion of a user's body to one or two-dimensions. In this way, the exercise machine may focus the resistance and efforts of the user to an isolated muscle, or group of muscles.

Exercise machines use gravity, friction, tension, compression, and/or hydraulic forces to provide isolated resistance to the user. Exercise machines further provide optimized biomechanical movement and resistance for the user's body by incorporating various combinations of cables, cams, springs, elastomeric bands, hydraulic cylinders, levers, and pulleys into the machine's design. Exercise machine are thus specifically designed to provide exact, repeatable biomechanical motions that are calculated to optimize desired muscular development. In theory, any user that performs weight training on an exercise machine will achieve the muscular development for which the exercise machine was specifically designed.

Despite the general benefits of exercise machines, currently available devices have a number of shortcomings that result in less effective muscular development and potential joint and muscular injury to the user. For example, some exercise machines fail to consider and provide correct anatomical joint motion for the user. Some machines further fail to consider the structural anatomy of the targeted muscle group to optimally contract and extend the muscles for maximum efficiency and development.

As a specific example, currently available exercise machines for developing the chest muscles fail to consider and address the correct anatomical joint motion of the shoulder and torso. This failure in design results in muscle sheering as the user is required to apply or resist a force for which the targeted muscle group or the corresponding joints are not properly aligned. Muscle sheering may cause tissue scaring, tearing of the muscle tissue, and/or injury to the joint, tendons, and ligaments. The resultant pain and inflammation associated with these types of injuries may result in decreased physical ability of the user, as well as arthritis. These types of injuries may also cause or exacerbate poor posture of the user. In response to the pain, the user is forced to compromise their form and body position thereby reducing the effectiveness of the exercise, and potentially leading to additional and/or long-term injuries.

Thus, while exercise machines for developing the skeletal muscles are available, challenges still exist. Accordingly, there is a need in the art for an improved exercise machine that overcomes the current challenges. Such a device is disclosed herein.

BRIEF SUMMARY OF THE INVENTION

The present invention relates to exercise machines. More particularly, the present invention relates to an exercise machine that combines the motions of a pushup with a dumbbell fly with the user in a prone or pushup position. The exercise machine comprises various features to ensure proper biomechanical motion of the user thereby preventing injury and maximizing efficiency in muscular development.

Some implementations of the present invention include an exercise machine that combines the motions of a pushup with a dumbbell fly to develop the user's chest muscles. In some instances, the exercise machine is used from a prone or pushup position, whereby the exercise machine is placed on the floor at a position generally beneath the user's chest. The exercise machine comprises a track or rail on which is slidably mounted a pair of platforms, each platform comprising a handle. The track is oriented beneath the user such that the platforms move laterally and medially along the track relative to the median sagittal plane of the user's body when in use. In some instances, the track further includes a central bridge which divides the track into a right half and a left half. The track may further include a right end bridge and a left end bridge which cap the right and left ends of the track, respectively. In some instances, the left platform is retained in the left half by the presence of the central bridge and the left end bridge. Similarly, the right platform is retained in the right half by the presence of the central bridge and the right end bridge.

Some implementations of the present invention further comprise one or more tension elements that increase the resistance of the medial and/or proximal sliding motions of the left and right handles within their respective sides. In some instances, the tension element comprises an elastomeric band having a first end that is attached to the platform and a second end that is attached to the handle's end bridge. In these instances, the resistance of the medial motion is increased as tension is applied to the tension element by sliding the platform medially. In other instances, the tension element comprises an elastomeric band having a first end that is attached to the platform and a second end that is attached to the middle bridge. In these instances, the resistance of the lateral motion is increased as tension is applied to the tension element by sliding the platform laterally. Further, in some instances a first tension element is coupled to the platform and the respective end bridge, and a second tension element is further coupled to the platform and the middle bridge, thereby increasing the resistance of the medial and proximal sliding motions of the platform.

In some instances, the end bridges are laterally and medially adjustable relative to the middle bridge, thereby setting and limiting a maximum distance between the platform and handles. In some implementations of the present invention, the left and right end bridges are adjusted medially on the track to achieve a user-specific, maximum distance between the handles. This maximum distance between the handles provides anatomically and biomechanically correct motion of the user's shoulder joint throughout the user's motion on the exercise machine, thereby maximizing the efficiency and safety of the exercise for the user.

Some implementations of the present invention further comprise an exercise machine having a first platform that slides medially and laterally independent of the medial and lateral sliding motions of a second platform. As such, the user's independent movement of each platform isolates the effectiveness of the exercise to the user's left and right muscle groups, respectively. This feature further prevents the user from relying predominantly on their dominant side to complete the exercise.

In some instances, the present invention further includes a method for maximizing the efficiency and safety of muscle development while using the exercise machine disclosed herein. For example, in some instances a method is provided having a first step for adjusting the left and right end bridges to set a maximum distance between the handles, wherein the maximum distance between the handles is equal to a distance between the creases of the user's elbows when the user is in the prone position and the elbows are bent to approximately 90°. The method further includes a step for grasping the handles and sliding the platforms laterally to provide the maximum distance between the handles. The user then bends their elbows to lower their chest towards the exercise machine until their elbows are bent to approximately 90° (i.e., the power position). The user then extends their arms, thereby raising their chest to a starting position. The user then adducts and rotates their humeri medially while maintaining the starting position. With the user's humeri adducted and rotated medially, the user then slides the left and right handles medially or inward towards the middle bridge. The user then returns the handles to the maximum distance position while abducting and rotating the user's humeri laterally, thereby returning the user to the starting position.

In other instances, the exercise machine of the present invention may be oriented and positioned by the user to provide resistance weight training to the user's abdomen, deltoids, inner thighs, outer thighs, biceps, and triceps.

DESCRIPTION OF THE DRAWINGS

It will be appreciated by those of ordinary skill in the art that the various drawings are for illustrative purposes only. The nature of the present invention, as well as other embodiments of the present invention, may be more clearly understood by reference to the following detailed description of the invention, to the appended claims, and to the several drawings.

DETAILED DESCRIPTION

Figure 1:
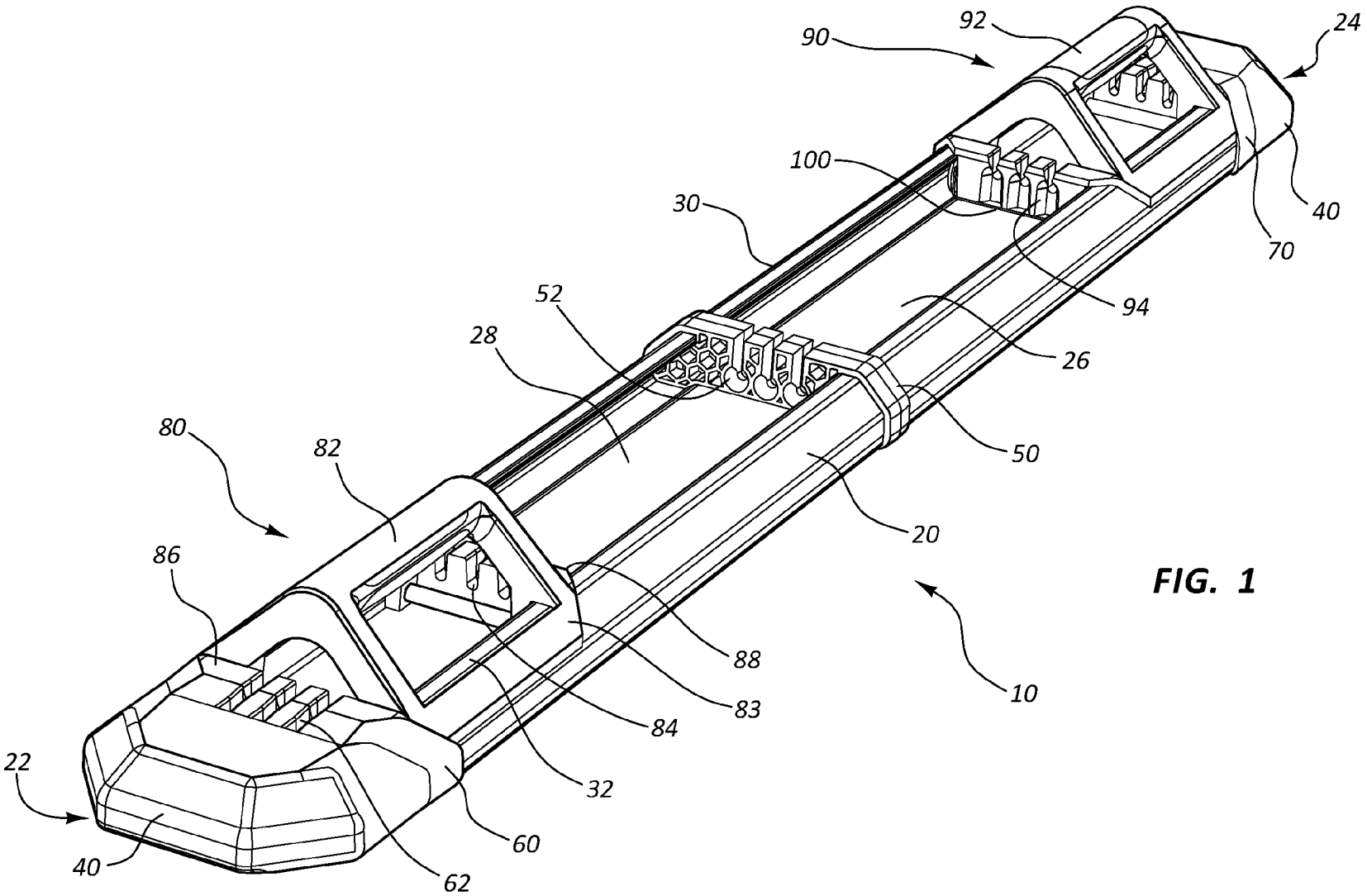
FIG. 1 is a perspective view of an exercise machine in accordance with a representative embodiment of the present invention.

The present invention relates to exercise machines. More particularly, the present invention relates to an exercise machine that combines the motions of a pushup with a dumbbell fly with the user in a prone or pushup position. The exercise machine comprises various features to ensure proper biomechanical motion of the user thereby preventing injury and maximizing efficiency in muscular development. The present disclosure further relates to apparatuses, systems, and methods related to exercising the muscles of the chest, shoulder and triceps. It will be appreciated by those skilled in the art that the embodiments herein described, while illustrating certain embodiments, are not intended to so limit this disclosure or the scope of the appended claims. Those skilled in the art will also understand that various combinations or modifications of the embodiments presented herein can be made without departing from the scope of this disclosure.

DEFINITIONS

As used herein, the term "arc structure" is understood to describe the anatomical structure of skeletal muscles within the human body. In particular, arc structure describes the orientation of muscles tissue in the body which results from a portion of the muscle being attached to a stable bone, and another portion of the muscle being attached to a mobile bone. Maximum muscle development is achieved when resistance to and movement of a muscle group utilizes the arc structure of that muscle group.

As used herein, the term "biomechanically correct" is understood to describe a condition or motion where the natural, anatomical movement of the muscles, joints, arc structure, bone structure, and posture of the user is maintained during the fulfillment of an exercise.

As used herein, the terms "prone position" or "pushup position" are understood to describe a position of the user's body when using an exercise machine disclosed herein, wherein the user's body is supported above the ground in a generally horizontal position by the user's hands and toes which are in contact with the ground. These terms may also describe a position of the user's body wherein the user's body is supported above the ground in a generally horizontal position by the user's hands and knees which are in contact with the ground.

Some embodiments of the present invention provide an exercise machine configured to combine several exercise movements into a single device. In particular, some exercise machines of the present invention combine the movements of a bench press, dumbbell press, cable crossovers, flyes, Pec Deck, and pushups into a single device. The exercise machines of the present invention further provide various adjustable components whereby the user may fit the machine to their individual anatomy, thereby achieving biomechanically correct movement and resistance to their isolated muscle groups. Thus, embodiments in accordance with the present disclosure are biomechanically correct to facilitate maximum development, comfort, safety, and enjoyment for the user.

Some embodiments in accordance with the present disclosure provide an exercise machine that is safe for use. Specifically, some exercise machines of the present invention provide resistance or workload that is consistent, gradual, and progressive, thereby allowing the body to adapt as it moves through the range of motion. The gradual increase of tension eliminates jerky and ballistic movements which may result in injury. Also, the resistance provided by the exercise machine is applied equally and independently to both sides of the user's body. As such, each side of the user's body is required to carry its own workload, thus increasing the effectiveness of workout and muscle development.

Some embodiments in accordance with the present disclosure further provide an exercise machine that maximizes effectiveness to the user. Some designs of the present invention provide full range of motion for the user, whereby both arms of the user are required to push or pull against a resistance, thereby optimally contracting the muscles of the chest, shoulders, and triceps. The exercise machine further provides biomechanically correct posture to the user throughout the user's movements on the machine. In some instances, the exercise machine is configured to flow with the structures of the user's body without creating discomfort or awkward movements. The exercise machine is thus configured to accommodate the joint structure, joint motion, muscular arc structure, and posture of the user to maximize efficiency and comfort.

The embodiments of the present invention are further designed to eliminate friction in each movement of the exercise machine. Thus, the present invention provides the user with smooth and comfortable transitions in the movements of the machine. Further, the exercise machines of the present invention comprise a simple construction and layout that is easily and readily understood by the user. Thus, a user may easily and accurately perform exercise movements on the machine and achieve the desired results.

Figure 2:
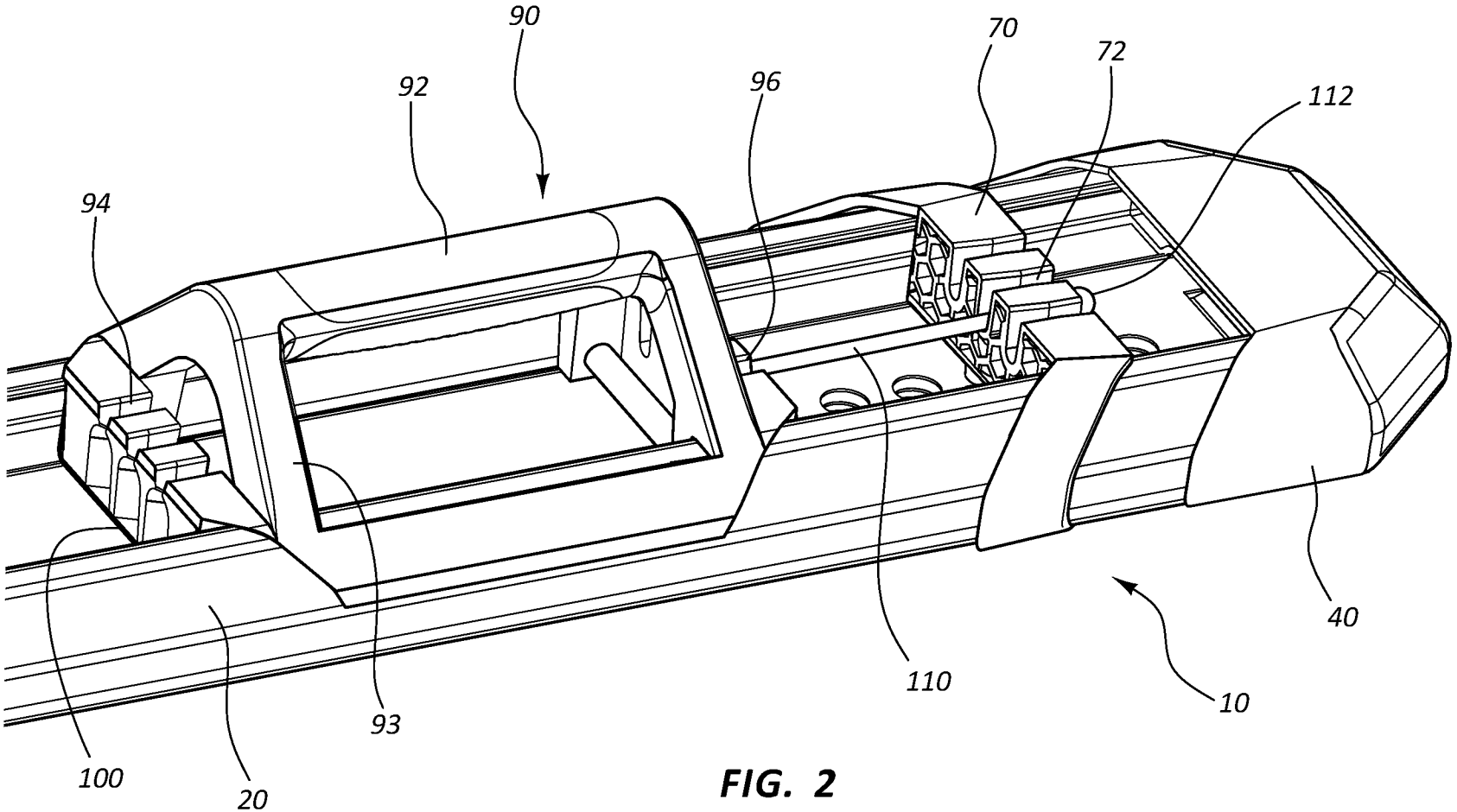
FIG. 2 is a detailed perspective view of the exercise machine of FIG. 1 in accordance with a representative embodiment of the present invention.

Referring now to FIGS. 1 and 2, an exercise machine 10 is shown. Exercise machine 10 comprises a track 20 having a first end 22, a second end 24, and a middle extending therebetween. Track 20 may comprise any material or combination of materials that are compatible for use in an exercise machine. For example, in some embodiments track 20 comprises an extruded metallic material, such as aluminum or steel. In other embodiments, track 20 comprises an injection molded polymer material, such as polycarbonate or polypropylene. Further still, in some embodiments track 20 comprises a composite material.

Track 20 may comprise any length, width, and/or height as may be desired. Track 20 may also comprise any cross-sectional shape or design as may be desired. In some instances, track 20 comprises a U-shaped, cross-sectional profile forming a longitudinal channel 26 between first and second ends 22 and 24. In some instances, channel 26 comprises an inner base surface 28 and sidewalls 30. Sidewalls 30 may further include a lip 32 that reduces a width of the opening of channel 26. In some instances, lip 32 is configured to engage with, and thereby retain a component within channel 26, as discussed below.

In some embodiments, first and second ends 22 and 24 further comprise an end cap 40. End cap 40 is configured to close first and second ends 22 and 24 of channel 26. In some embodiments, end cap 40 comprises the same material as track 20. In other embodiments, end cap 40 comprises a slip-resistant material configured to increase friction between track 20 and a surface on which track 20 is supported. For example, in some embodiments end cap 40 comprises a rubber polymer material.

In some instances, exercise machine 10 further comprises a middle bridge 50. Middle bridge 50 is secured within channel 26 at a central position between first and second ends 22 and 24. In some embodiments, middle bridge 50 is immovable. In other embodiments, middle bridge 50 may be adjusted within channel 26, as may be desired.

Middle bridge 50 may comprise any material or combination of materials that is compatible for use in an exercise machine. In some instances, middle bridge 50 comprises a rigid material that is capable of withstanding pulling forces during use of the machine. Middle bridge 50 further comprises one or more notches 52. Notches 52 are configured to selectively receive one or more tensioning elements, such as an elastomeric band, which is discussed in detail below.

In some embodiments, exercise machine 10 further comprises a first end bridge 60 and a second end bridge 70. End bridges 60 and 70 are slidably mounted within channel 26 and further include notches 62 and 72, respectively. As with notches 52, notches 62 and 72 are also configured to selectively receive one or more tensioning elements, as may be desired.

In some instances, end bridges 60 and 70 have an outer surface that is shaped and configured to compatibly seat against end caps 40. In some embodiments, end bridges 60 and 70 are further configured and capable of being slid within channel 26 between cap 40 and middle bridge 50. End bridges 60 and 70 may further be configured to be selectively secured within channel 26 at any desired location between cap 40 and middle bridge 50. For example, in some embodiments end bridges 60 and 70 comprise a set screw that can be tightened to prevent movement of end bridges 60 and 70 within channel 26. End bridges 60 and 70 may further include other means for selectively securing their positions within channel 26, as is discussed below in connection with FIG. 4.

Exercise machine 10 further comprises a first platform 80 and a second platform 90. First and second platforms 80 and 90 are slidably positioned within channel 26 and are capable of freely moving within channel 26 between their respective end bridge (60, 70) and middle bridge 50. First and second platforms 80 and 90 each further comprise a handle 82 and 92. Handles 82 and 92 are generally positioned above channel 26 and are configured to support a user's hands when using exercise machine 10. The platforms and handles of the present invention may comprise any material or combination of materials disclosed herein. In some instances, the platforms and handles of exercise machine 10 comprise a rigid material that is capable of supporting the weight of a user during use of the device.

In some instances, the platform and handle comprise a single, monolithic unit or structure. In other instances, the handle is secured to the platform via one or more fasteners. Handle 82 or 92 may also be rotatably coupled to their respective platform, as is discussed below in connection with FIGS. 6A and 6B.

Platforms 80 and 90 further comprise one or more notches 84 and 94 which are configured to selectively receive one or more tensioning elements. In some instances, an outer edge 86 of platform 80 comprises a first set of notches, and an inner edge 88 of platform 80 comprises a second set of notches, wherein the first set of notches is aligned with notches 62 of end bridge 60, and wherein the second set of notches is aligned with notches 52 of middle bridge 50. The same modifications may be provided for platform 90. The aligned notches of the respective components are thus used in combination to support one or more tensioning elements, thereby providing resistance to the user of the machine 10.

For example, in some embodiments a first tensioning element is coupled between platform 80 and end bridge 60 via notches 84 and 62. In other embodiments, a second tensioning element is coupled between platform 90 and end bridge 70 via notches 94 and 72. Alternatively, a first tensioning device may be coupled between platform 80 and middle bridge 50 via notches 84 and 52, and a second tensioning device may be coupled between platform 90 and middle bridge 50 via notches 94 and 52. The various notches of the present invention may be configured to receive a single tensioning element, or may be configured to receive a plurality of tensioning elements.

In some instances, the tensioning elements comprise an elastic cord or elastomeric band having enlarged ends that are retained by the notches. A user may vary the tension between two components by either 1) adjusting the number of tensioning elements interconnecting the two components, 2) selecting tensioning elements having greater or lesser tensioning properties, or 3) adjusting the number of tensioning elements and selecting tensioning elements having greater of lesser tensioning properties. In some embodiments, the tensioning properties of the tensioning elements provide gradual and progressive resistance between the two interconnected components as the distance between the components increases. Thus, depending upon which components are interconnected via the tensioning elements, exercise machine 10 may provide medial and/or lateral resistance to the user. In some instances, platforms 80 and 90 are interconnected to both middle bridge 50, and end bridges 60 and 70 via a plurality of tensioning elements, thereby providing both medial and lateral resistance to the user.

In some embodiments, an extension 83 of handle 82 or platform 80 overlaps sidewall 30 and onto lip 32, as shown. This extension 83 may be provided to assist in maintaining proper placement and alignment of platform 80 when sliding within channel 26. Extension 83 may also be supported by sidewall 30 such that the weight of the user on handle 82 is transferred to sidewall 30 as platform 80 slides within channel 26. In other embodiments, extension 83 is provided merely as a cosmetic feature.

In some instances, platforms 80 and 90 further comprise a friction reducing material or device 100 to assist the platform in sliding within channel 26. Generally, this material or device 100 reduces or eliminates friction between platforms 80 and 90 and channel 26, thereby providing the platforms a smooth sliding motion. In some instances, friction reducing device 100 comprises one or more wheels. In other instances, friction reducing device 100 comprises a bearing. Friction reducing device 100 may further comprise a low friction coating or material, such as polytetrafluoroethylene. In some embodiments, channel 26 further comprises a friction reducing material.

Referring now to FIG. 2, a detailed view of exercise device 10 is shown. In some embodiments, end bridge 70 may be selectively slid and secured at any position between end cap 40 and middle bridge 50. End bridge 70 further comprises one or more notches that is configured to selectively receive one or more tensioning elements 110. As discussed previously, tensioning element 110 may comprise any material or structure that is compatible for use in the present system. In some embodiments, tensioning element 110 comprises an elastomeric band having a terminal ends that are wider than notches 72 and 96, and further having a middle section that is narrower than notches 72 and 96. As such, the middle section of tensioning element 110 is seated into notches 72 and 96 with the element's terminal ends being positioned outside of the notches. Tension between platform 90 and end bridge 70 gradually increases as platform 90 is slid medially inward towards middle bridge 50.

Figure 3A:
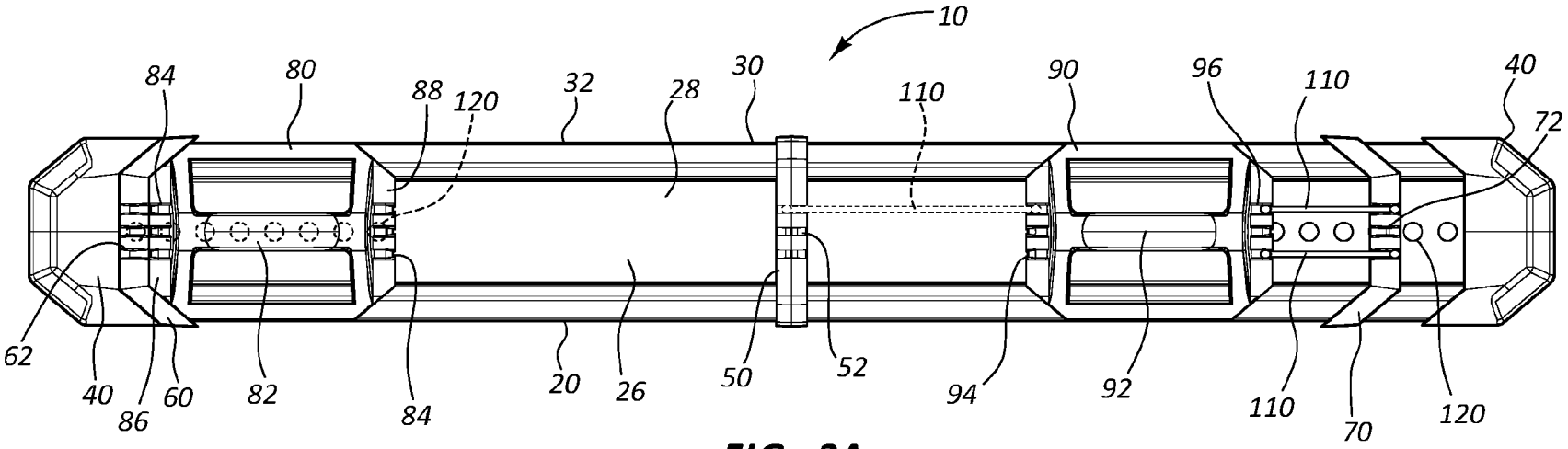
FIG. 3A is a top plan view of an exercise machine in accordance with a representative embodiment of the present invention.
Figure 3B:
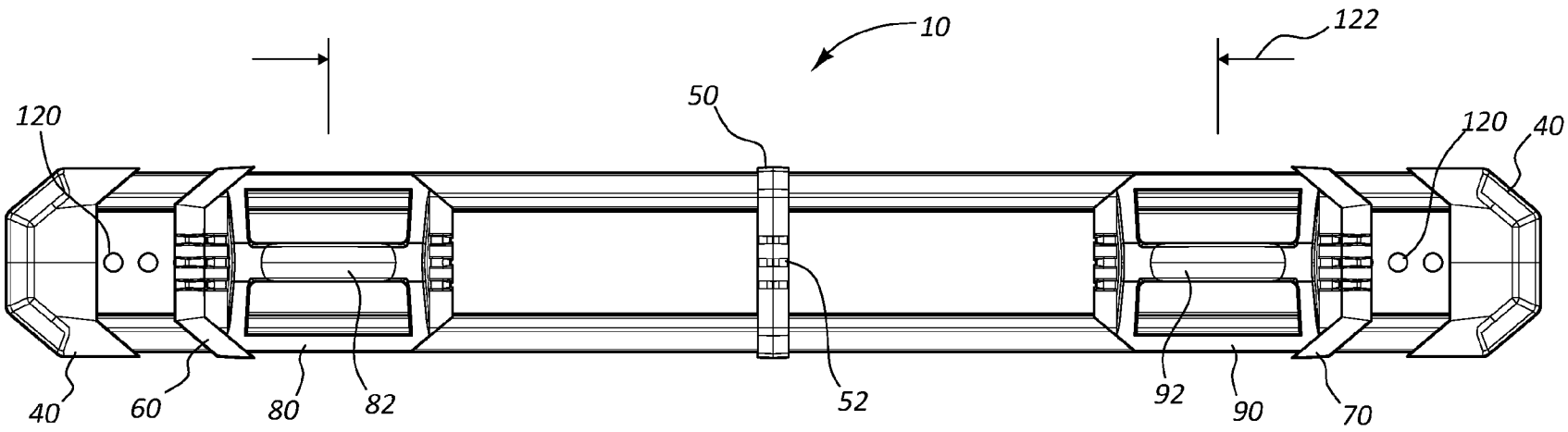
FIG. 3B is a top plan view of an exercise machine demonstrating a maximum distance between the handles of the device in accordance with a representative embodiment of the present invention.

Referring now to FIG. 3A, a top view of a representative embodiment of an exercise machine 10 is shown. In some embodiments, track 20 further comprises a plurality of holes or detents 120 that are configured to receive a pin or set screw of end bridges 60 and 70, thereby retaining a position of end bridges 60 or 70 within channel 26. Exercise machine may alternatively use any system or device to retain a desired position of end bridges 60 and 70 within channel 26.

In some embodiments, end bridges 60 and 70 are adjusted by the user to provide a maximum distance 122 between handles 82 and 92 when platforms 80 and 90 are seated against their respective end bridges. Maximum distance 122 is determined based upon the specific anatomy of the user. In particular, maximum distance 122 is approximately equal to the distance between the user's elbow creases when the user is in a prone position with their elbows bent at approximately 90°. When properly set, maximum distance 122 ensures that exercise machine 10 is configured to provide the user with biomechanically correct movements and motions while using the machine, thereby increasing efficiency and decreasing the risk for injury.

Figure 4:
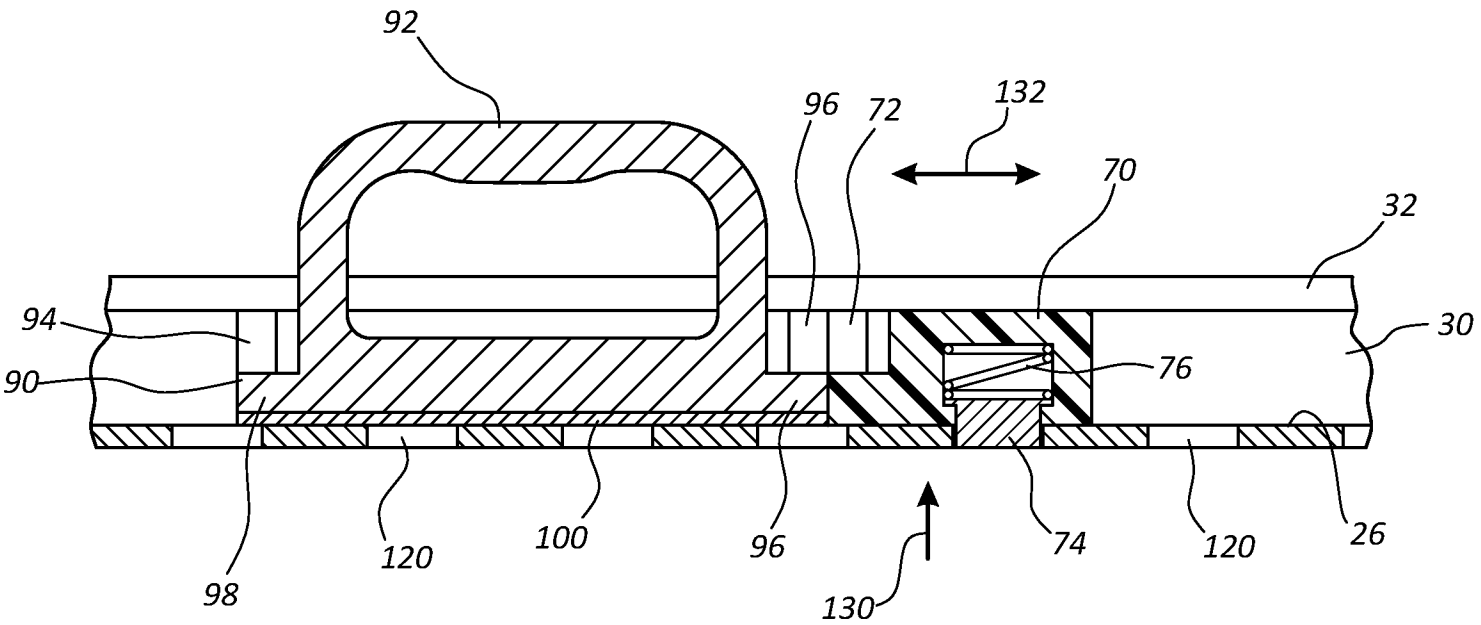
FIG. 4 is a detailed cross-section view of an end bridge and platform of an exercise machine in accordance with a representative embodiment of the present invention.

Generally, exercise machine 10 comprises means for selectively adjusting the position of end bridges 60 and 70 within channel 26. In some instances, end bridge 70 comprises a spring loaded pin or button 74 that is located on the bottom surface of the end bridge and extends downwardly beyond the bottom surface, as shown in FIG. 4. Button 74 is biased outwardly by spring 76 such that button 74 remains engaged with hole or detent 120. Once engaged, movement of end bridge 70 relative to track 20 is prevented. End bridge 70 may be moved by depressing 130 button 74 while simultaneously sliding 132 end bridge 70 within channel 26 to a desired location. Button 74 is again biased into a new hole 120 when proper alignment between button 74 and the hole is achieved.

Figure 5:
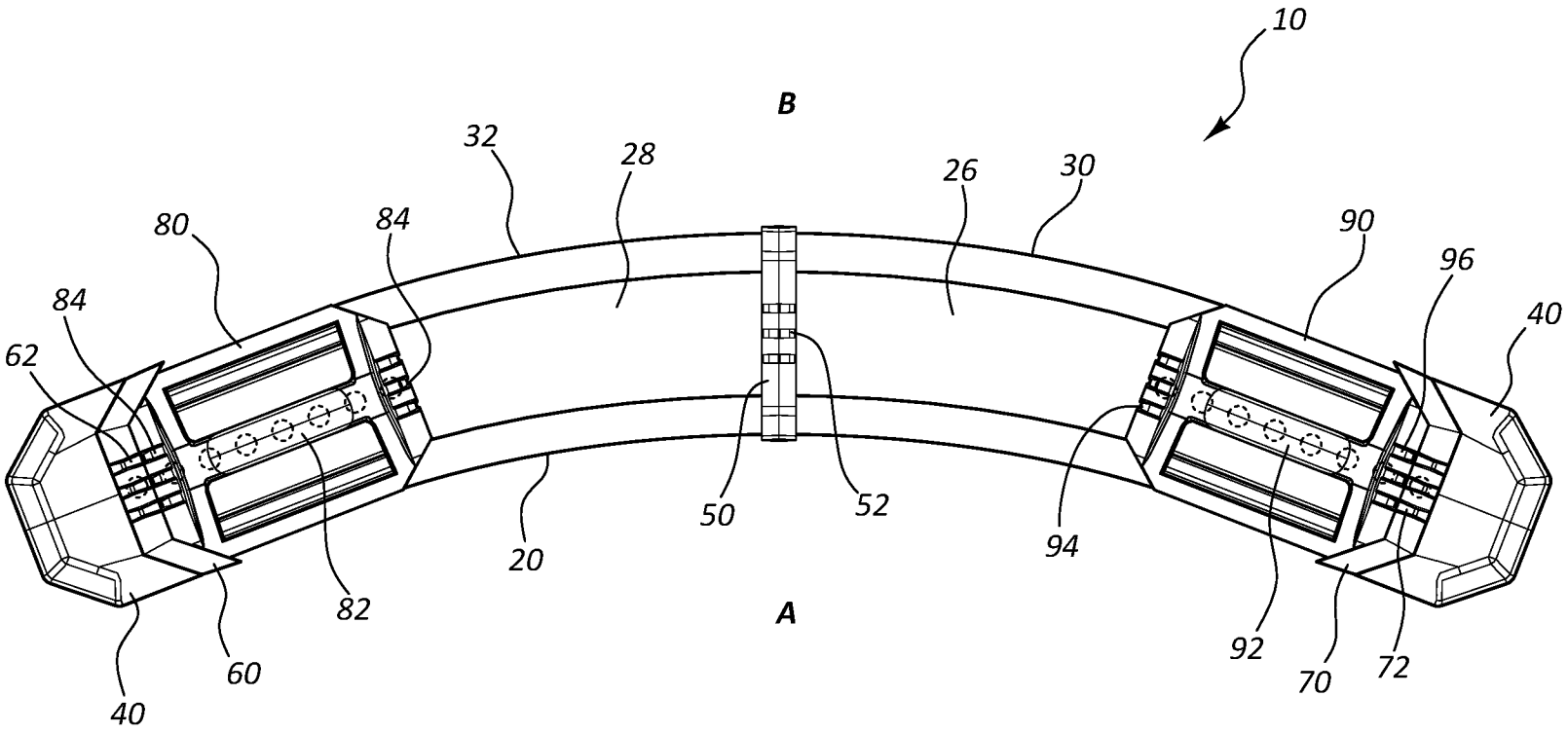
FIG. 5 is a top plan view of an arched exercise machine in accordance with a representative embodiment of the present invention.

Referring now to FIG. 5, an exercise machine 10 is shown having an arched track 20 and channel 26. The arched configuration of track 20 provides the user with biomechanically correct movement to contract and expand different regions of the chest muscles. For example, the upper pectoral muscles are maximally contracted and extended when the user mounts exercise machine 10 from side A and slides handles 82 and 92 inwardly towards middle bridge 50. Conversely, the lower pectoral muscles are maximally contracted and extend when the user mounts exercise machine 10 from side B and slides handles 82 and 92 inwardly towards middle bridge 50. Thus, in some embodiments an exercise machine is provided having a non-linear track configuration to provide additional biomechanically correct movements for the user.

Figure 6A:
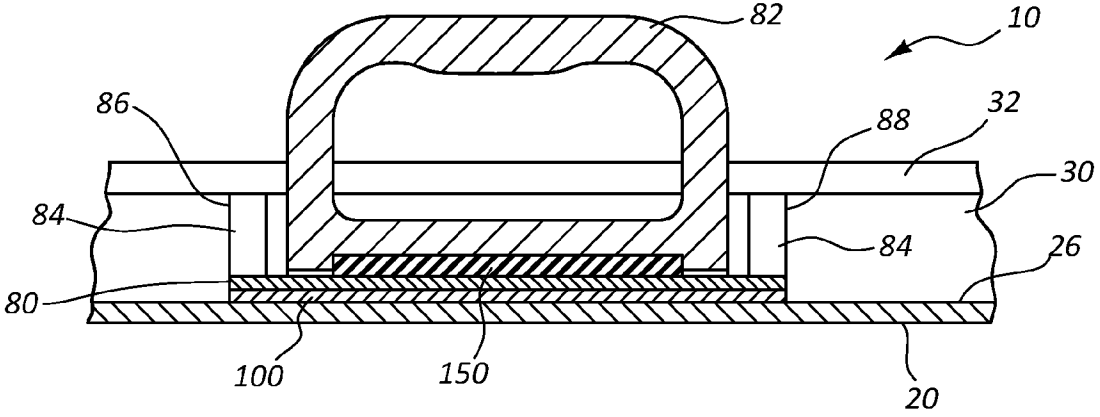
FIG. 6, shown in parts A and B, shows detailed cross-section views of a platform and swivel handle of an exercise machine in accordance with a representative embodiment of the present invention.
Figure 6B:
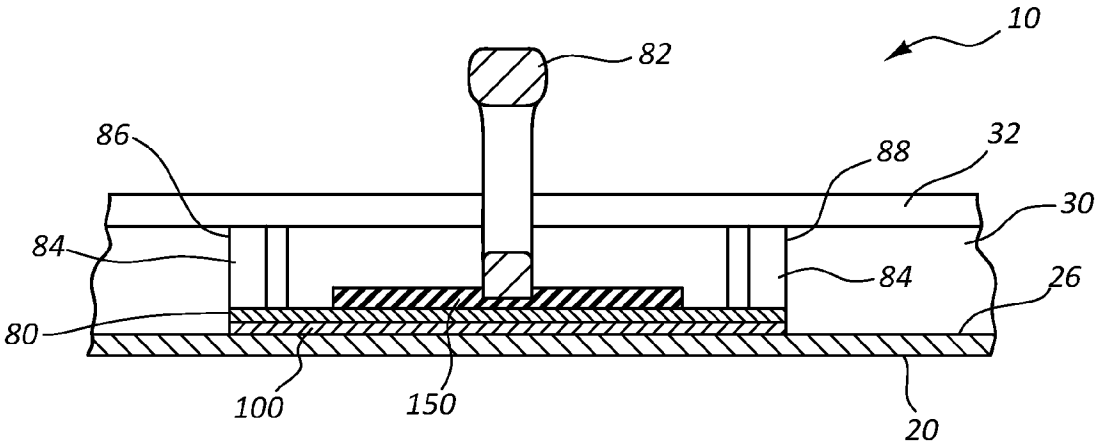

In some instances, exercise machine 10 further comprises a handle 82 that is rotatably coupled to platform 80 via a swivel 150, as shown in FIGS. 6A and 6B. Thus, handle 82 may be rotated relative to the stationary position of platform 80. For example, in some embodiments handle 82 is rotated to be parallel to the length of channel 26, as shown in FIG. 6A. In other embodiments, handle 82 is rotated 90° to be perpendicular to the length of channel 26, as shown in FIG. 6B. In some instances, handle 82 comprises a set pen or other means for locking a desired rotated position of handle 82. In other instances, handle 82 may freely rotate throughout the movement of platform 80 within channel 26.

Figure 7A:
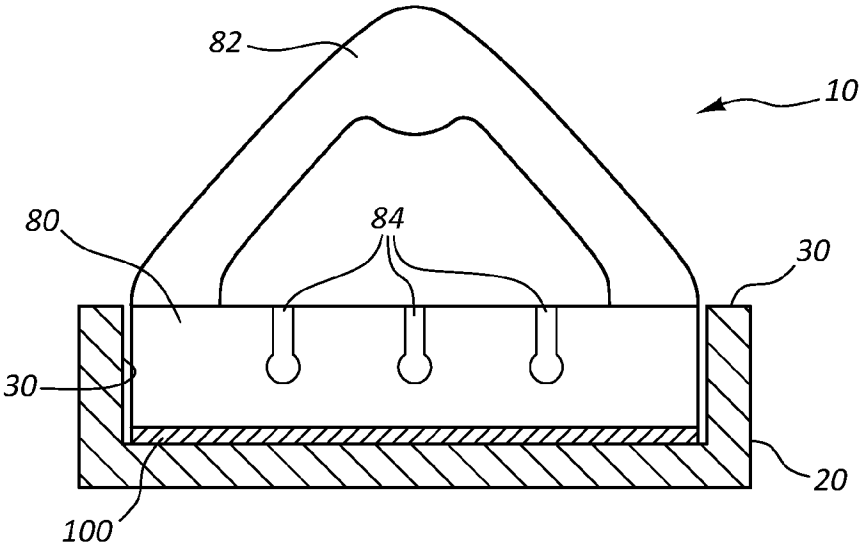
FIG. 7, shown in parts A and B, shows a top plan view and cross-section end view of an exercise machine in accordance with a representative embodiment of the present invention.
Figure 7B:
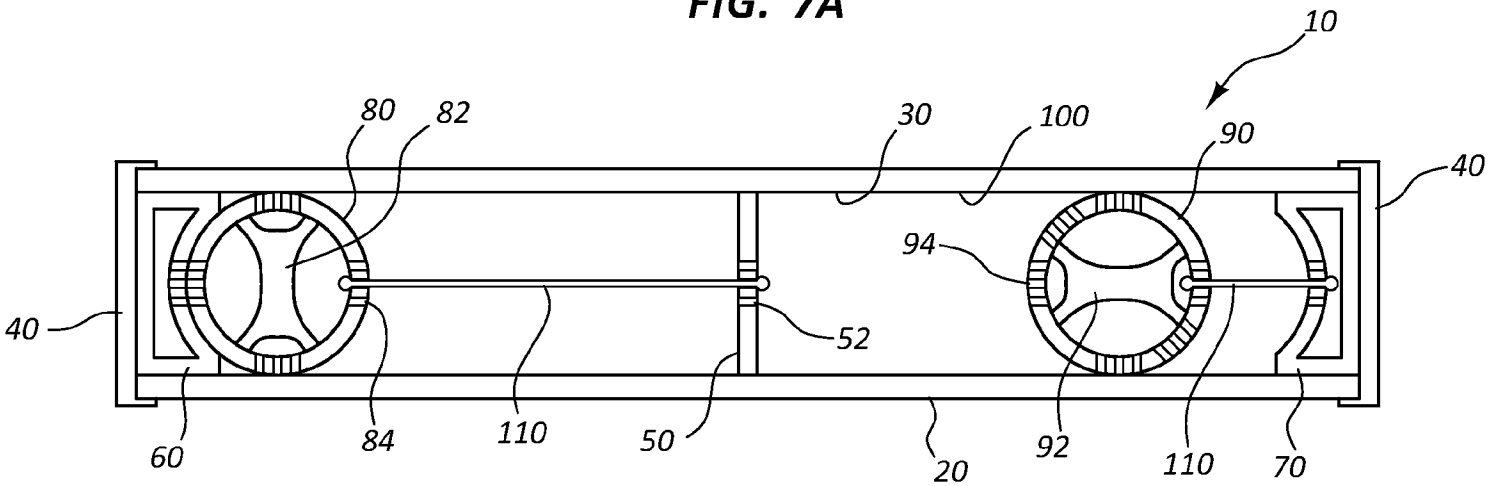

Referring now to FIGS. 7A and 7B, in some embodiments platform 80 is removably and rotatably seated into channel 26. Channel 26 may be configured with straight sidewalls 30 and without a lip, thereby permitting platform 80 to be dropped into and lifted out of channel 26, as desired. Platform 80 similarly comprises straight sidewalls and an overall width that is slightly less than the inner diameter of channel 26. Platform 80 further comprises a friction reducing material 100 that is interposedly positioned between platform 80 and channel 26. In some instances, additional friction reducing material is applied to at least one of sidewall 30, and the sidewall of platform 80. As such, platform 80 is configured to slide within channel 26 between middle bridge 50 and end cap 40. Platform 80 is further configured to rotate freely within channel 26.

In some instances, exercise machine 10 further comprises a plurality of notches 84 and 94 arranged around the perimeter of platform 80 and/or 90. In some embodiments, the plurality of notches 84 and 94 are arranged around the entire perimeter of platform 80 and/or 90. In other embodiments, the plurality of notches are arranged around the perimeter at desired degrees of rotation, such as 0°, 45°, 90°, 135°, 180°, 220°, and 265°. The placement of these notches permits the user to attach tensioning element 110 between the platform and end bridge or middle bridge with handle 82 or 92 at any desired rotational position. This configuration further permits the user to slightly adjust the rotational position of handles 82 and 92 throughout the contraction and extension motions of the machine, thus providing the user with biomechanically correct movement.

Figure 8B:
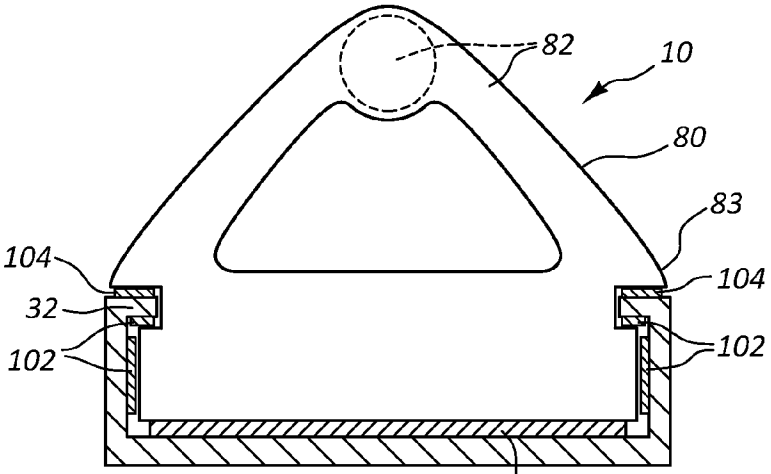
FIG. 8, shown in parts A-C, shows partial cross-section views of exercise machines in accordance with various representative embodiments of the present invention.
Figure 8C:
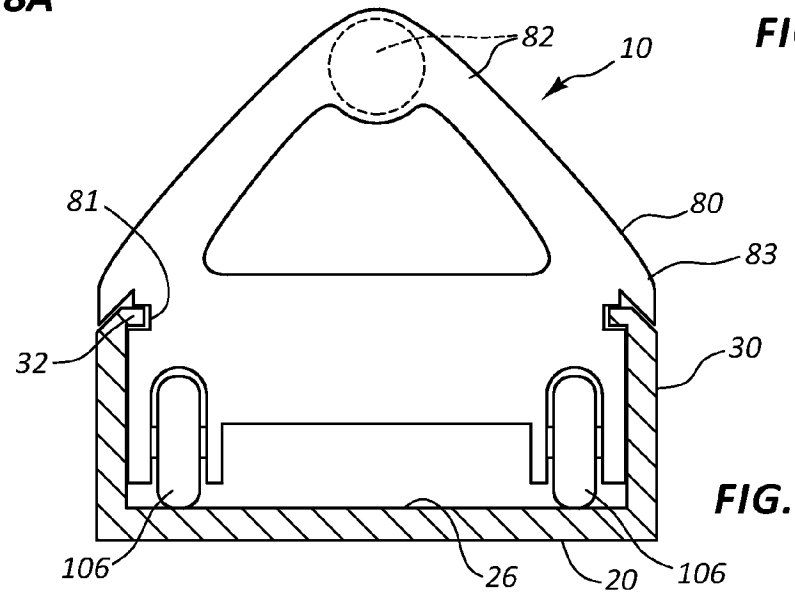
Figure 8A:
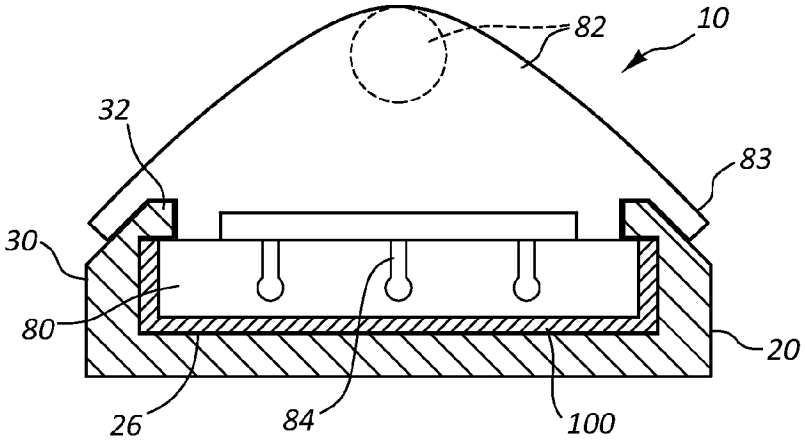

Referring now to FIGS. 8A-8C, various configurations of platform 80 and track 20 are provided. In some instances, track 20 comprises a lip 32 that extends inwardly into channel 26 and interconnects with platform 80 and/or handle 82. The intersection between platform 80 and track 20 further comprises an interaction between extension 83 and an outer surface of lip 32. In this configuration, removal of platform 80 from track 20 is not possible unless end cap 40 and end bridge 60 are removed from track 20, thereby opening an end of track 20.

In some instances, channel 26 and the inner surface of sidewall 30 further comprises a friction reducing material or coating 100. Material 100 provides a low-friction barrier between platform 80 and channel 26, thereby providing smooth movement of platform 80 therein. In other instances, material 100 is alternatively applied to the undersurface and perimeter sidewall surfaces of platform 80. As such, material 100 is again interposedly positioned between platform 80 and channel 26.

Further still, in some instances a first material 100 is applied to the undersurface of platform 80, and a second material 102 is applied to channel 26, as shown in FIG. 8B. A third material 104 may be applied to the outer surface of lip 32 so as to be interposed between lip 32 and extension 83 of platform 80. One having skill in the art will appreciate that material 100 may be applied to any number of surfaces to reduce friction between platform 80 and track 20, as disclosed herein.

With reference to FIG. 8C, in some embodiments platform 80 comprises a set of wheels 106. Wheels 106 are configured to reduce friction between platform 80 and channel 26. In some embodiments, platform 80 further comprises a retention groove 81 into which lip 32 is partially inserted. Retention groove 81 prevents platform 80 from being removed from channel 26. Platform 80, channel 26, lip 32, and/or retention groove 81 may additionally comprise one or more friction reducing materials, within the spirit of the present disclosure.

Figure 9:
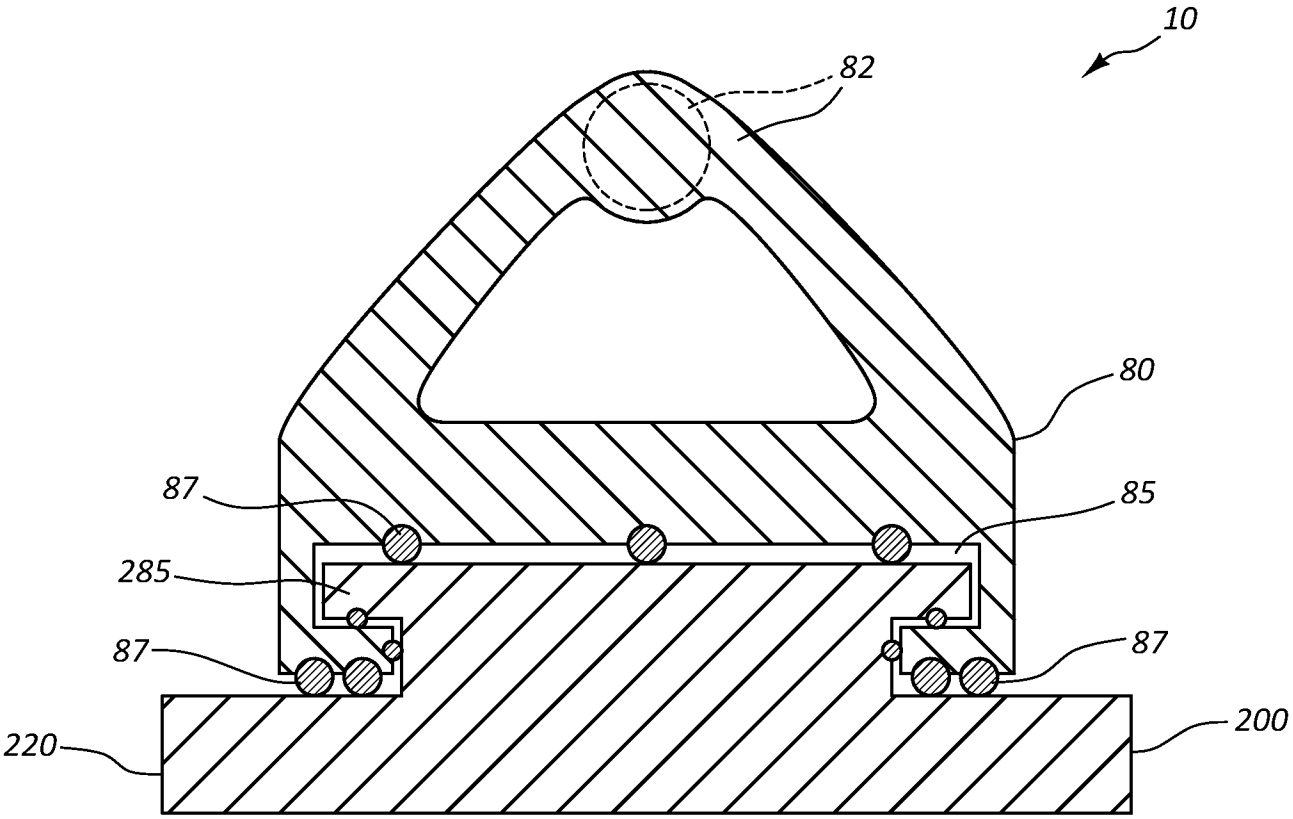
FIG. 9 shows a cross-section end view of an exercise machine in accordance with a representative embodiment of the present invention.

In some embodiments, exercise machine 10 comprises a rail 200 in place of a track, as shown in FIG. 9. Thus, in some embodiments platform 80 comprises a C-shaped channel 85 that is configured to compatibly receive a T-shaped extension 285 of rail 200. Channel 85 may further comprise a friction reducing device, material, and/or coating to reduce friction between platform 80 and rail 200. For example, in some embodiments channel 85 comprises a plurality of ball bearings 87. In other instances, extension 285 comprises a friction reducing material and/or coating. In some instances, rail 200 further comprises a base 220 having an extended width configured to increase the stability of exercise machine 10.

Figure 10:
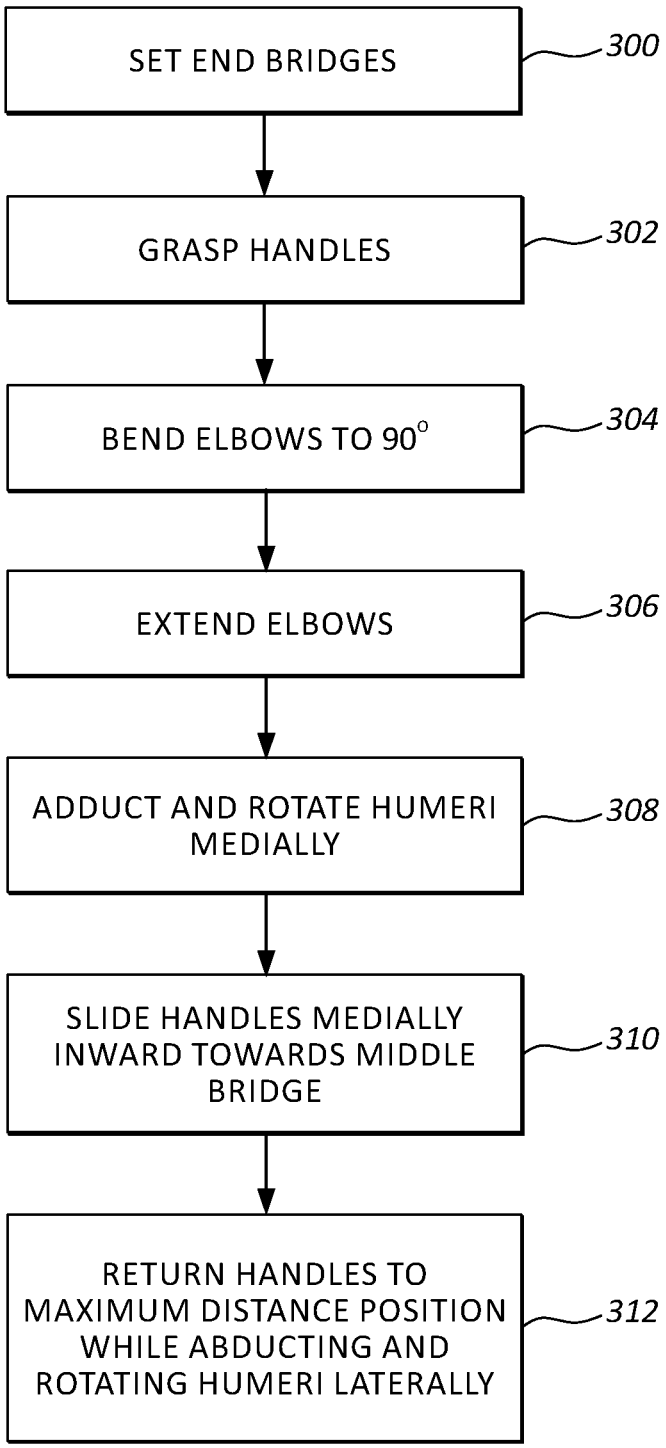
FIG. 10 is a flowchart providing a method for using an exercise machine to maximize efficiency in muscle development in accordance with a representative embodiment of the present invention.

Referring now to FIG. 10, a method for maximizing the efficiency and safety of muscle development is shown. This method may be followed when using exercise device 10. Alternatively, this method may be provided as instruction when teaching a user how to properly use exercise device 10.

In some embodiments, a method for maximizing the efficiency and safety of muscle development includes a first step 300 of adjusting the end bridges of the exercise machine to set the correct maximum distance between the handles of the device. This step sets the machine to provide a personal power position for the user. This step may further include a sub-step for determining the correct maximum distance by measuring the distance between the user's elbow creases when bent to approximately 90° while in the prone position. The user then grasps the handles of the exercise machine while in the prone position, with their elbows fully extended and the handles separated at the maximum distance (at step 302). This may be referred to as the starting position. The user then bends their elbows to lower their chest towards the middle bridge of the machine to a maximum depth (at step 304). As the user lowers their chest, the user's humeri are abducted and rotated laterally, thereby opening their chest to achieve a full stretch. The user then extends their arms, thereby straightening their elbows and returning returns to the starting position (at step 306).

At this point the user adducts and rotates their humeri medially while maintaining the starting position (at step 308). While holding the adducted and rotated position of the humeri, the user slides the handles medially inward towards the middle bridge (at step 310). The user then returns the handles to the maximum distance while simultaneously abducting and rotating their humeri laterally (at step 312). Steps 302 to 312 may be referred to as one complete repetition.

When performing the steps of the method shown in FIG. 10, steps 302 to 312 are performed as a single continuous motion. In some embodiments, the resistance provided by the tensioning elements is applied in a single horizontal direction. However, the exercise takes place in two directions, namely, vertical and horizontal directions. Thus, the exercise according to the method shown in FIG. 10 may be described as having two vectors which creates two motions or two types of resistance in one positive fluid movement. The first or vertical movement is much like a pushup, wherein the user's arms are straight with the user's hands gripping the handles. The forearms should be generally parallel to one another during the vertical movement, i.e. the user's elbows should not go inside or outside of this position. The forearms should also be generally perpendicular or normal to the plane of the floor or surface on which the exercise machine is supported. At the top of the movement, or the starting position, the arms are fully extended. When the humeri are adducted and rotated medially, the chest should concave slightly.

The second or horizontal movement involves the hands being brought together by sliding the handles inwardly towards the middle bridge. The arms are then returned to the starting position, thereby completing the repetition.

As user gains increased strength during the course of an exercise program, the resistance of exercise machine 10 may be gradually increased to continue to provide an effective exercise for the user. Additional resistance may be provided by the use of additional tensioning elements 110 which are placed into the plurality of notches on the various components of the machine, as described above. Dependent upon the skill of the user, the exercise may be completed while being supported either on the knees or the toes. For the novice user, the exercise is completed with the user's knees in contact with the floor and in close proximity to the exercise machine. Increased resistance is achieved as the user increases the distance between their knees and the exercise machine.

For the advanced user, the exercise is completed with the user's body being supported solely by the user's hands and toes. Elastomeric bands or straps may further be placed across the back of the user to increase resistance during the first or vertical movement at steps 304 and 306. For example, in some instances a middle portion of an elastomeric band or strap is positioned across the back of the user while each end of the strap is further secured to the exercise machine. In other instances, the middle portion of the elastomeric band or strap is positioned across the back of the user while each end of the strap is held by the user with the handle. In some embodiments, track 20 comprises one or more loops that is configured to receive and retain the ends of the elastomeric band. In other embodiments, the additional elastomeric band is secured beneath or around a portion of track 20. Thus, as the user raises the body during the vertical movement, the additional elastomeric straps provide increased resistance to the movement.

Figure 11A:
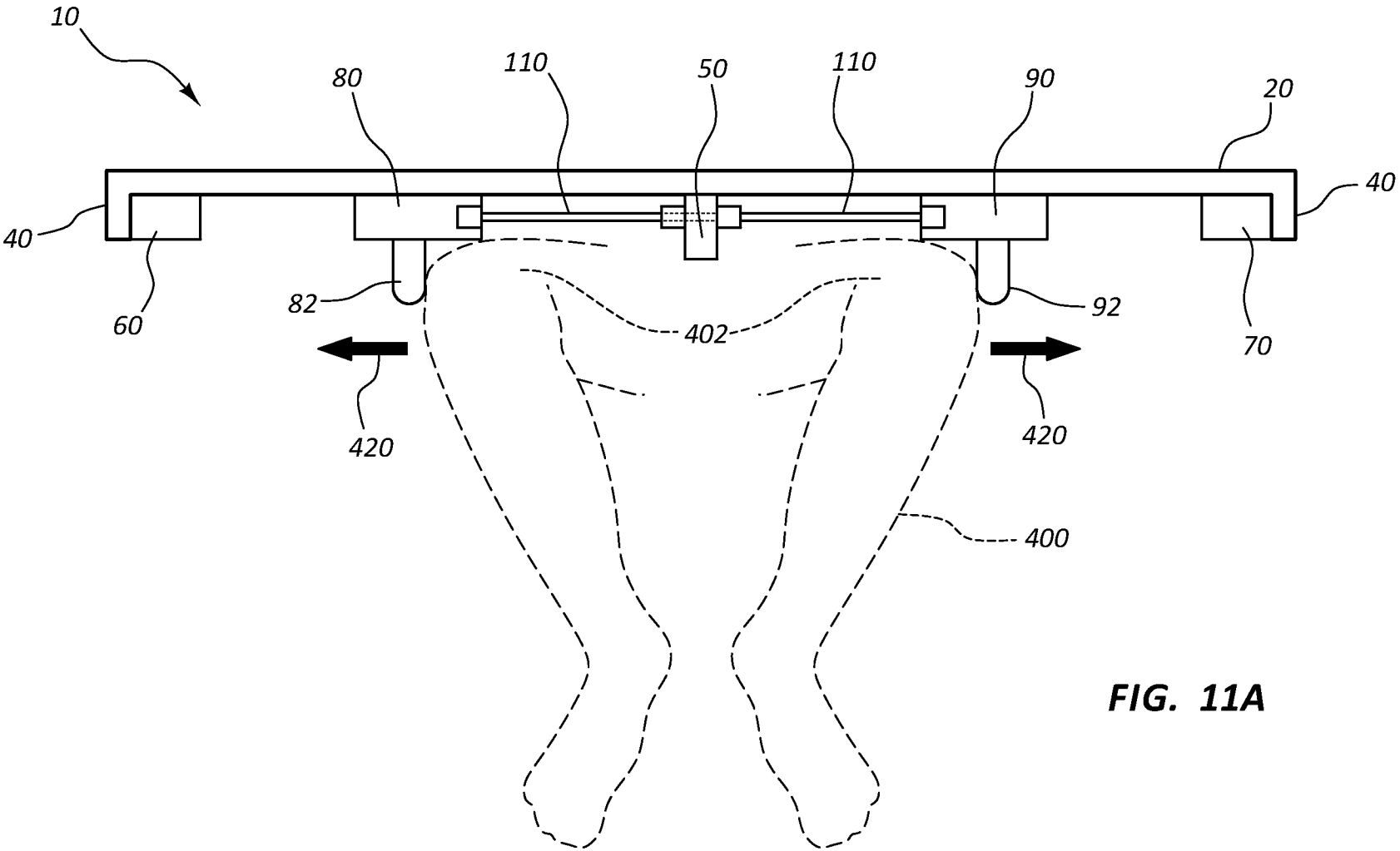
FIG. 11, shown in parts A and B, shows plan front views of an exercise machine being used in an alternative orientation to exercise the lateral hips, gluteus, and inner thighs of the user in accordance with a representative embodiment of the present invention.
Figure 11B:
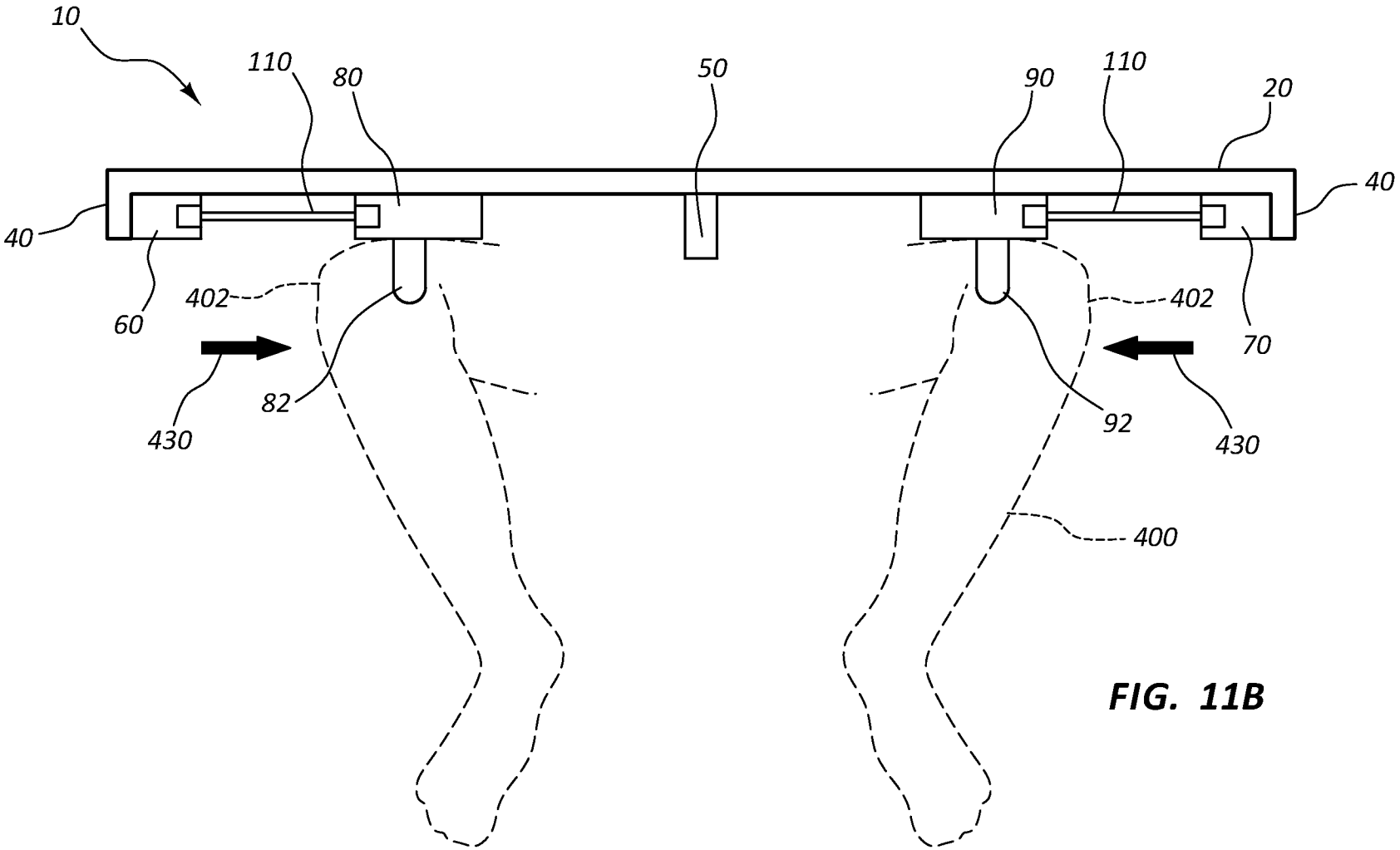

Referring now to FIGS. 11A and 11B, exercise machine 10 may be used in an alternative orientation to exercise the lateral hips, gluteus, and inner thighs of the user 400. For example, to exercise the lateral hips and gluteus, a desired number of tensioning elements 110 are interconnected between each of the platforms and middle bridge 50, as shown in FIG. 11A. The user 400 is then seated as on a stool or chair, with the knees 402 bent. Exercise machine 10 is then placed on the user's knees 402 such that the platforms rest on the top surface of the user's knees 402, and the handle of each platform contacts the lateral surface of the knee. The user then moves their knees 402 laterally outward 420, thereby gradually and progressively increasing the resistance between the platforms and middle bridge 50.

To exercise the inner thighs, a desired number of tensioning elements 110 are interconnected between each of the platforms and their respective end bridges, as shown in FIG. 11B. The user 400 is then seated on a stool or chair, with knees 402 bent. Exercise machine 10 is then placed on the user's knees 402 such that the platforms rest on the top surface of the user's knees 402, and the handles of each platform contacts the medial surface of the knees. Alternatively, exercise machine 10 may be placed facing upwards on the floor and the user is seated on the floor with the knees straight and placed on the outsides of the handles. The user then moves their knees 402 medially inward 430, thereby gradually and progressively increasing the resistance between the platforms and their respective end bridges.

Figure 12A:
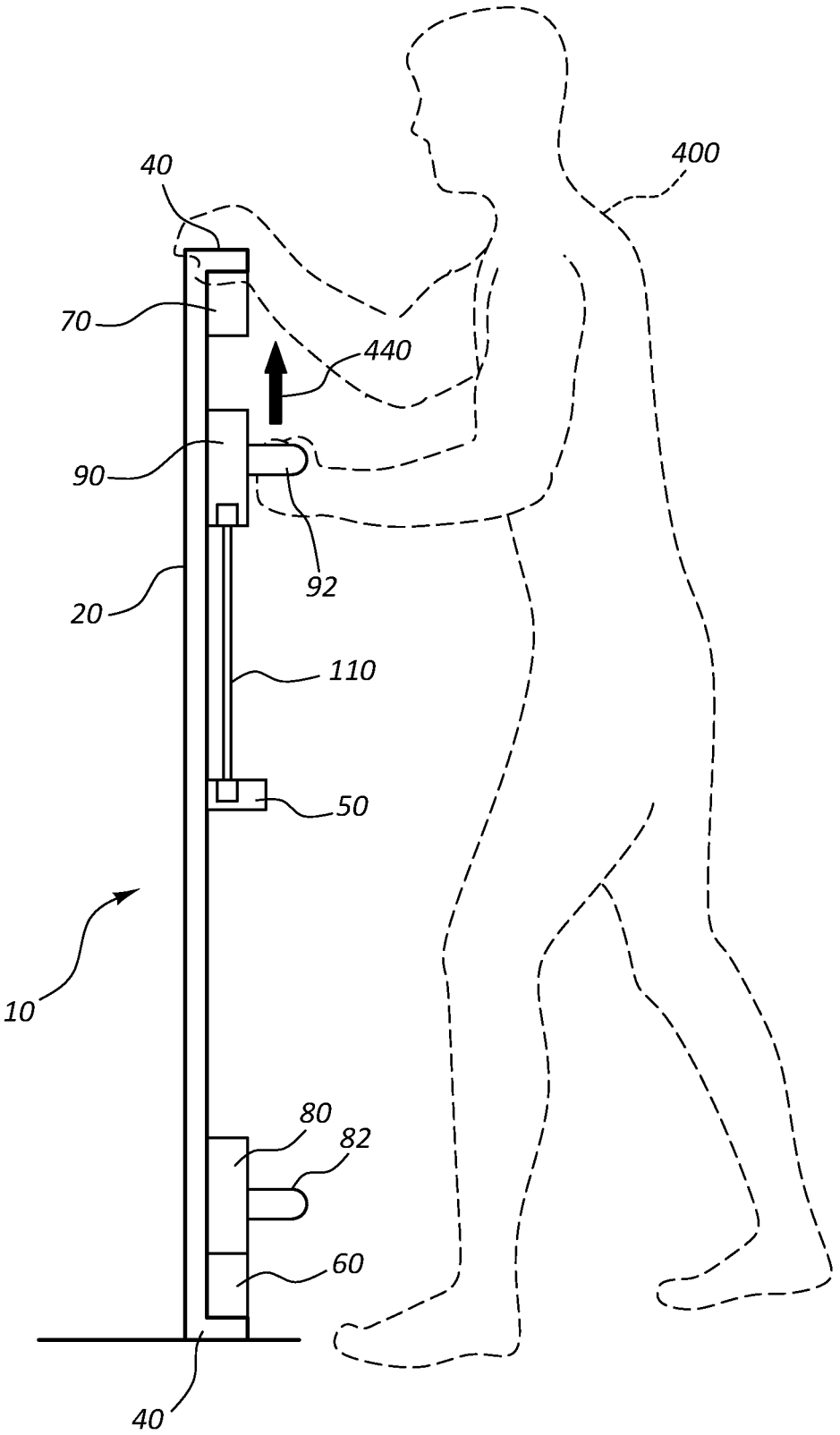
FIG. 12, shown in parts A and B, shows plan side views of an exercise machine being used in an alternative orientation to exercise the biceps and triceps of the user in accordance with a representative embodiment of the present invention.
Figure 12B:
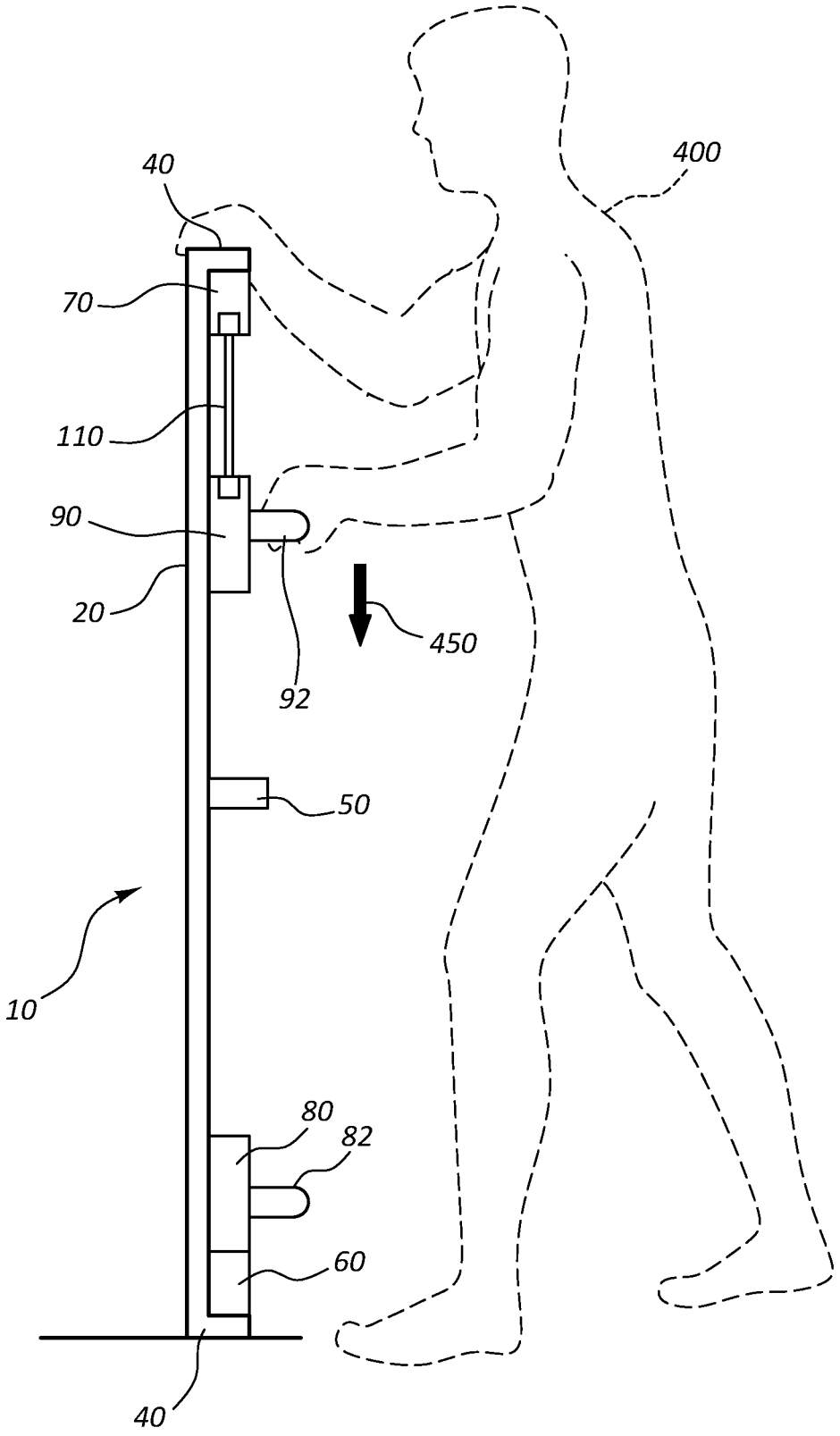

Referring now to FIGS. 12A and 12B, exercise machine 10 may be used in an alternative orientation to exercise the biceps and triceps of the user 400. For example, to exercise the bicep, a desired number of tensioning elements 110 are interconnected between platform 90 and middle bridge 50, as shown in FIG. 12A. The opposite end of the machine is placed on the floor such that the exercise machine is in a vertical position and the interconnected components 90 and 50 are oriented above the unconnected components 60 and 80. The user 400 steadies the exercise machine 10 with one hand while grasping the handle 92 with their other hand. The user then pulls handle 92 upwardly 440 while curling their bicep, thereby gradually and progressively increasing the resistance between middle bridge 50 and platform 90.

To exercise the triceps, a desired number of tensioning elements 110 are interconnected between platform 90 and end bridge 70, as shown in FIG. 12B. The opposite end of the machine is placed on the floor such that the exercise machine is in a vertical position and the interconnected components 90 and 70 are oriented above the unconnected components 50, 80 and 60. The user 400 steadies the exercise machine 10 with one hand while grasping the handle 92 with the other hand. The user then pushes downwardly 450 while extending the elbow, thereby gradually and progressively increasing the resistance between platform 90 and end bridge 70.

Figure 13:
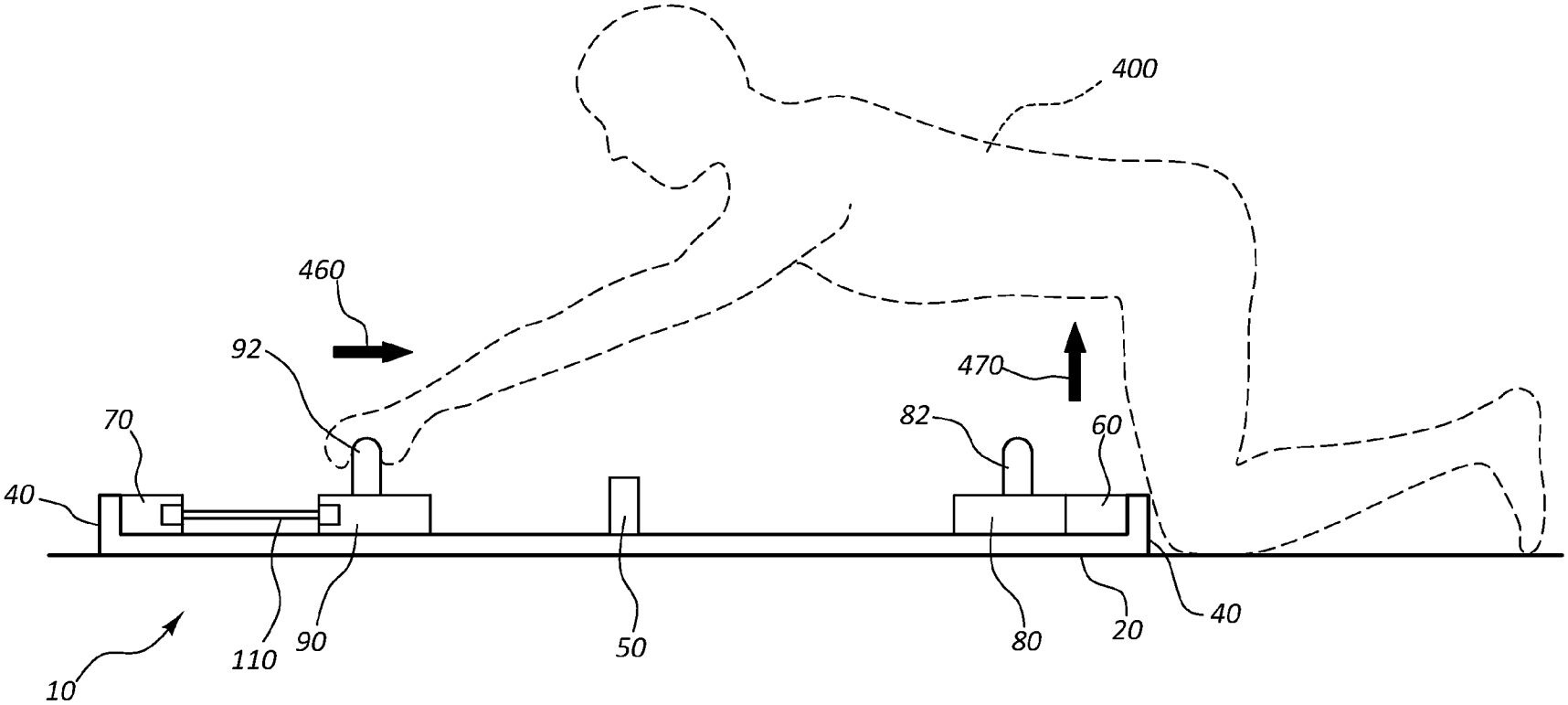
FIG. 13 shows a plan side view of an exercise machine being used to exercise the abdominal muscles of the user in accordance with a representative embodiment of the present invention.

Exercise machine 10 may further be used to exercise the abdominal muscles of a user 400. First, a desired number of tensioning elements 110 are interconnected between platform 90 and end bridge 70, as shown in FIG. 13. Exercise machine 10 is then laid on the floor with the handles in an upward orientation. The user 400 kneels proximate to end cap 40 and end bridge 60, such that the interconnected components 70 and 90 opposite the user and the user is generally parallel to the long axis of track 20. The user 400 reaches across middle bridge 50 and grasps handle 92 with one or both hands. The user then pulls handle 92 inwardly 460 while simultaneously contracting the users abdominal muscles in an upward direction 470 to curl the abdomen, thereby gradually and progressively increasing the resistance between platform 90 and end bridge 70.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. An exercise machine, comprising:

a track having a first end, a second end, and a middle interposed therebetween, the track further comprising a channel, a sidewall, an inner surface, an outer surface, and a horizontal lip;

a middle bridge fixedly coupled to the middle of the track;

a first and second end cap fixedly coupled to the first and second ends of the track, respectively;

a first end bridge adjustably coupled to the inner and outer surfaces of the track at a position between the first end cap and the middle bridge, and comprising a channel for receiving the horizontal lip;

a second end bridge adjustably coupled to the inner and outer surfaces of the track at a position between the second end cap and the middle bridge, and comprising a channel for receiving the horizontal lip;

a first platform slidably coupled to the track between the middle bridge and the first end bridge and configured to slide between the first end bridge and the middle bridge in a lateral direction, the first platform having a first handle fixedly coupled to a top surface of the first platform, the first handle comprising a gripping surface configured to accommodate a user's hand, the gripping surface having a top surface to support the user's palm and further comprising a gap between a bottom surface of the handle and the top surface of the first platform whereby the user's fingers contact the bottom surface of the first handle when gripped, the first handle further comprising a central axis defined by a length of the gripping surface, wherein the central axis of the first handle is fixed in an orientation that is parallel to the lateral direction, the first platform further comprising a horizontal groove parallel to the top surface of the first platform for receiving the horizontal lip of the track to prevent removal of the first platform from the track, wherein the horizontal lip of the track is parallel to the top surface of the first platform and to the horizontal groove;

a second platform slidably coupled to the track between the middle bridge and the second end bridge and configured to slide between the second end bridge and the middle bridge in the lateral direction, the second platform having a second handle fixedly coupled to a top surface of the second platform, the second handle comprising a gripping surface configured to accommodate a user's hand, the gripping surface having a top surface to support the user's palm and further comprising a gap between a bottom surface of the handle and the top surface of the second platform whereby the user's fingers contact the bottom surface of the second handle when gripped, the second handle further comprising a central axis defined by a length of the gripping surface, wherein the central axis of second handle is fixed in an orientation that is parallel to the lateral direction and the central axis of the first handle, the second platform further comprising a horizontal groove parallel to the top surface of the first platform for receiving the horizontal lip of the track to prevent removal of the second platform from the track, wherein the horizontal lip of the track is parallel to the top surface of the second platform and to the horizontal groove, the second platform being configured to move independent of the first platform; and a set of wheels coupled to each of the first and second platforms and in contact with the channel of the track;

a first set of notches provided on the first end bridge and the first platform;

a second set of notches provided on the second end bridge and the second platform;

a first tensioning element coupled to the first set of notches wherein the first tensioning element biases the first platform outwardly against the first end bridge; and a second tensioning element coupled to the second set of notches, wherein the second tensioning element biases the second platform outwardly against the second end bridge.

2. The exercise machine of claim 1, wherein the track further comprises a plurality of holes configured to selectively receive a pin of the first end bridge and the second end bridge to provide a fixed position for the first and second end bridges on the track.

3. The exercise machine of claim 2, wherein the fixed position of the first and second end bridges may be slidably adjusted within the track along the horizontal lip to increase and decrease a distance between each end bridge and the middle bridge.

4. The exercise machine of claim 1, wherein the middle bridge is secured to the track at a position approximately centered between the first and second end bridges.

5. The exercise machine of claim 1, wherein each of the first and second tensioning elements comprises a plurality of tensioning elements.

6. The exercise machine of claim 1, wherein each of the first and second tensioning elements is an elastomeric band.

7. The exercise machine of claim 1, wherein the first and second sets of notches are each configured to receive one or more tensioning elements.

8. The exercise machine of claim 1, wherein the first and second sets of notches further comprise a tapered opening configured to receive a terminal end of the first and second tensioning elements, wherein a maximum width of the terminal end is greater than a minimum width of the tapered opening such that the terminal end is prevented from passing through the minimum width of the tapered opening when the platform is slid medially inward towards the middle bridge.

9. The exercise machine of claim 1, wherein the channel, the sidewalls, and the horizontal lip of the track receive and retain the first and second end bridges, the first and second platforms, the first and second end caps, and the middle bridge.

10. An exercise machine, comprising:

a track having a first end, a second end, and a middle interposed therebetween, the track further comprising a channel, a sidewall, an inner surface, an outer surface, and a horizontal lip defining an interior of the track;

a middle bridge fixedly coupled to the middle of the track and in contact with the inner and outer surfaces of the track, the middle bridge further comprising a groove for receiving the horizontal lip;

a first and second end cap fixedly coupled to the first and second ends of the track, respectively;

a first end bridge coupled to the inner and outer surfaces of the track and slidably adjustable between the first end cap and the middle bridge, the first end bridge having a groove for receiving the horizontal lip;

a second end bridge coupled to the inner and outer surfaces of the track and slidably adjustable between the second end cap and the middle bridge, the second end bridge having a groove for receiving the horizontal lip;

a first platform slidably coupled to the inner and outer surfaces of the track and configured to slide between the first end bridge and the middle bridge, the first platform having a first handle fixedly coupled to a top surface of the first platform, and further having a groove for receiving the horizontal lip of the track;

a second platform slidably coupled to the inner and outer surface of the track and configured to slide between the second end bridge and the middle bridge, the second platform having a second handle fixedly coupled to a top surface of the second platform, and further having a groove for receiving the horizontal lip of the track;

a set of wheels coupled to each of the first and second platforms and in contact with the channel of the track;

a first set of notches provided on the first end bridge and the first platform;

a second set of notches provided on the second end bridge and the second platform;

a first tensioning element coupled to the first set of notches wherein the first tensioning element biases the first platform outwardly against the first end bridge; and a second tensioning element coupled to the second set of notches, wherein the second tensioning element biases the second platform outwardly against the second end bridge.

11. The exercise machine of claim 10, wherein the track further comprises a plurality of holes configured to selectively receive a pin of the first end bridge and the second end bridge to provide a fixed position for the first and second end bridges on the track.

12. The exercise machine of claim 11, wherein the fixed position of the first and second end bridges may be slidably adjusted within the track along the horizontal lip to increase and decrease a distance between each end bridge and the middle bridge.

13. The exercise machine of claim 10, wherein each of the first and second tensioning elements comprises a plurality of tensioning elements.

14. The exercise machine of claim 10, wherein the first and second sets of notches are each configured to receive one or more tensioning elements.

15. The exercise machine of claim 10, wherein the first and second sets of notches further comprise a tapered opening configured to receive a terminal end of the first and second tensioning elements, wherein a maximum width of the terminal end is greater than a minimum width of the tapered opening such that the terminal end is prevented from passing through the minimum width of the tapered opening when the platform is slid medially inward towards the middle bridge.

16. The exercise machine of claim 15, wherein the tapered opening is positioned within the interior of the track.

17. The exercise machine of claim 10, wherein the end bridges and the middle bridge are ring shaped such that the end bridges and the middle bridge wrap around the outer surface.

18. An exercise machine, comprising:

a track having a first end, a second end, and a middle interposed therebetween, the track further comprising a channel, a sidewall, an inner surface, an outer surface, and a horizontal lip defining an interior of the track;

a middle bridge fixedly coupled to the middle of the track and in contact with the inner and outer surfaces of the track, the middle bridge further comprising a groove for receiving the horizontal lip;

a first and second end cap fixedly coupled to the first and second ends of the track, respectively;

a first end bridge coupled to the inner and outer surfaces of the track and slidably adjustable between the first end cap and the middle bridge, the first end bridge having a groove for receiving the horizontal lip;

a second end bridge coupled to the inner and outer surfaces of the track and slidably adjustable between the second end cap and the middle bridge, the second end bridge having a groove for receiving the horizontal lip;

a first platform slidably coupled to the inner and outer surfaces of the track and configured to slide between a resting position and a stressed position, wherein the first platform contacts the first end bridge in the resting position and contacts the middle bridge in the stressed position;

a second platform slidably coupled to the inner and outer surface of the track and configured to slide between a resting position and a stressed position, wherein the second platform contacts the second end bridge in the resting position and contact the middle bridge in the stressed position;

a set of wheels coupled to each of the first and second platforms and in contact with the channel of the track;

a first set of notches provided on the first end bridge and the first platform;

a second set of notches provided on the second end bridge and the second platform;

a first tensioning element coupled to the first set of notches wherein the first tensioning element biases the first platform outwardly against the first end bridge; and a second tensioning element coupled to the second set of notches, wherein the second tensioning element biases the second platform outwardly against the second end bridge.

19. The exercise machine of claim 18, wherein each of the first and second tensioning elements comprises a plurality of tensioning elements.

* * * * *